US009920270B2

(12) United States Patent
Robinson et al.

(10) Patent No.: US 9,920,270 B2
(45) Date of Patent: Mar. 20, 2018

(54) LOW SULFUR MARINE BUNKER FUELS AND METHODS OF MAKING SAME

(71) Applicants: Christopher E. Robinson, Southampton (GB); Sara Dawe, Southampton (GB); Erik Karlsson, Winchester (GB); Hédi Grati, London (GB)

(72) Inventors: Christopher E. Robinson, Southampton (GB); Sara Dawe, Southampton (GB); Erik Karlsson, Winchester (GB); Hédi Grati, London (GB)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 164 days.

(21) Appl. No.: 14/943,313

(22) Filed: Nov. 17, 2015

(65) Prior Publication Data

US 2016/0160139 A1 Jun. 9, 2016

Related U.S. Application Data

(60) Provisional application No. 62/087,428, filed on Dec. 4, 2014.

(51) Int. Cl.

| | |
|---|---|
| ***C10G 45/02*** | (2006.01) |
| ***C10L 1/04*** | (2006.01) |
| ***C10G 45/08*** | (2006.01) |

(52) U.S. Cl.

CPC ..... *C10L 1/04* (2013.01); *C10G 45/02* (2013.01); *C10G 45/08* (2013.01);
(Continued)

(58) Field of Classification Search

CPC ..... C10L 1/04; C10L 2290/24; C10L 2200/0407; C10L 2270/00; C10G 45/02; C10G 45/08; C10G 2300/1077

See application file for complete search history.

(56) References Cited

U.S. PATENT DOCUMENTS

| | | | |
|---|---|---|---|
| 3,522,169 | A | 7/1970 | Ireland |
| 3,902,991 | A | 9/1975 | Christensen et al. |

(Continued)

FOREIGN PATENT DOCUMENTS

| | | |
|---|---|---|
| GB | 1209967 | 10/1970 |
| JP | 2006000726 | 6/2003 |

(Continued)

OTHER PUBLICATIONS

PCT/US2005/061015 International Search Report and Written Opinion dated Jan. 25, 2016.

(Continued)

*Primary Examiner* — Randy Boyer
*Assistant Examiner* — Juan Valencia
(74) *Attorney, Agent, or Firm* — Andrew T. Ward

(57) ABSTRACT

This invention relates to low sulfur marine bunker fuel compositions and methods of making the same. The invention also relates to an uncracked, hydrotreated vacuum resid for use in making the low sulfur marine bunker fuel composition. Contrary to conventional marine/bunker fuel compositions, the low sulfur marine/bunker fuel composition uses mostly uncracked components, including a (cat feed) hydrotreated vacuum resid. The low sulfur marine/bunker fuel composition can also have reduced contents of residual components.

13 Claims, 1 Drawing Sheet

(52) U.S. Cl.
CPC ..... *C10G 2300/1077* (2013.01); *C10L 2200/0407* (2013.01); *C10L 2270/00* (2013.01); *C10L 2290/24* (2013.01)

(56) References Cited

U.S. PATENT DOCUMENTS

| | | | |
|---|---|---|---|
| 4,006,076 | A | 2/1977 | Christensen et al. |
| 4,166,026 | A | 8/1979 | Fukui et al. |
| 4,420,388 | A | 12/1983 | Bertolacini et al. |
| 4,601,303 | A | 7/1986 | Jensen |
| 4,677,567 | A | 6/1987 | Grosser et al. |
| 4,808,298 | A | 2/1989 | Peck et al. |
| 6,156,695 | A | 12/2000 | Soled et al. |
| 6,162,350 | A | 12/2000 | Soled et al. |
| 6,187,174 | B1 | 2/2001 | Morel et al. |
| 6,299,760 | B1 | 10/2001 | Soled et al. |
| 6,447,671 | B1 | 9/2002 | Morel et al. |
| 6,554,994 | B1 | 4/2003 | Reynolds et al. |
| 6,582,590 | B1 | 6/2003 | Vargas et al. |
| 6,712,955 | B1 | 3/2004 | Vargas et al. |
| 6,783,663 | B1 | 8/2004 | Riley et al. |
| 6,863,803 | B1 | 3/2005 | Riley et al. |
| 6,929,738 | B1 | 8/2005 | Riley et al. |
| 7,229,548 | B2 | 6/2007 | Riley et al. |
| 7,288,182 | B1 | 10/2007 | Soled et al. |
| 7,410,924 | B2 | 8/2008 | Corma Canos et al. |
| 7,544,632 | B2 | 6/2009 | Soled et al. |
| 7,651,605 | B2 | 1/2010 | Sahara et al. |
| 2005/0277545 | A1 | 12/2005 | Shih et al. |
| 2006/0060502 | A1 | 3/2006 | Soled et al. |
| 2007/0084754 | A1 | 4/2007 | Soled et al. |
| 2008/0093262 | A1 | 10/2008 | Gragnani et al. |
| 2013/0340323 | A1 | 12/2013 | Stern et al. |

FOREIGN PATENT DOCUMENTS

| | | | |
|---|---|---|---|
| RU | 2213125 | | 11/1999 |
| WO | 1999057228 | | 11/1999 |
| WO | 2004007646 | A1 | 1/2004 |
| WO | 2007084437 | A2 | 7/2007 |
| WO | 2007084438 | | 7/2007 |
| WO | 2007084439 | A1 | 7/2007 |
| WO | 2007084471 | A1 | 7/2007 |
| WO | 2009001314 | A1 | 12/2008 |

OTHER PUBLICATIONS

T.N. Mitusova, I.A. Pugach, N.P. Averina, M.V. Bobkova and E.E. Safonova, "Primary and Secondary Distillates as Marine Fuel Oil", Chemistry and Technology of Fuels and Oils (2005), 41 (4), pp. 287-291.

J. Koudelka and J. Cir, "Technical and Economic Evaluation of Process for the Production of the Production of Low Sulfur Heating Oils", Ropa a Uhlie (RAU), 1979, 21(8), pp. 433-440.

P. Vulkov, G. Aleksiev, K. Kanariev, S. Vulkova and S. Klincheva, "A New Direction for Rational Use of Vacuum Gas Oil", Godishnik na Visshya Khim, Heski Institut, Sofiya (1979), 25(2), 146-48—translation into English.

W.R. Derr, Jr., "Moderate Pressure Hydrocracking of Heavy Vacuum Gas Oils", Energy Progress, 1986, vol. 6, No. 1, pp. 15-19.

"Implications Across the Supply Chain" (Sep. 30, 2009), Sustainable Shipping Conference in San Francisco, CA.

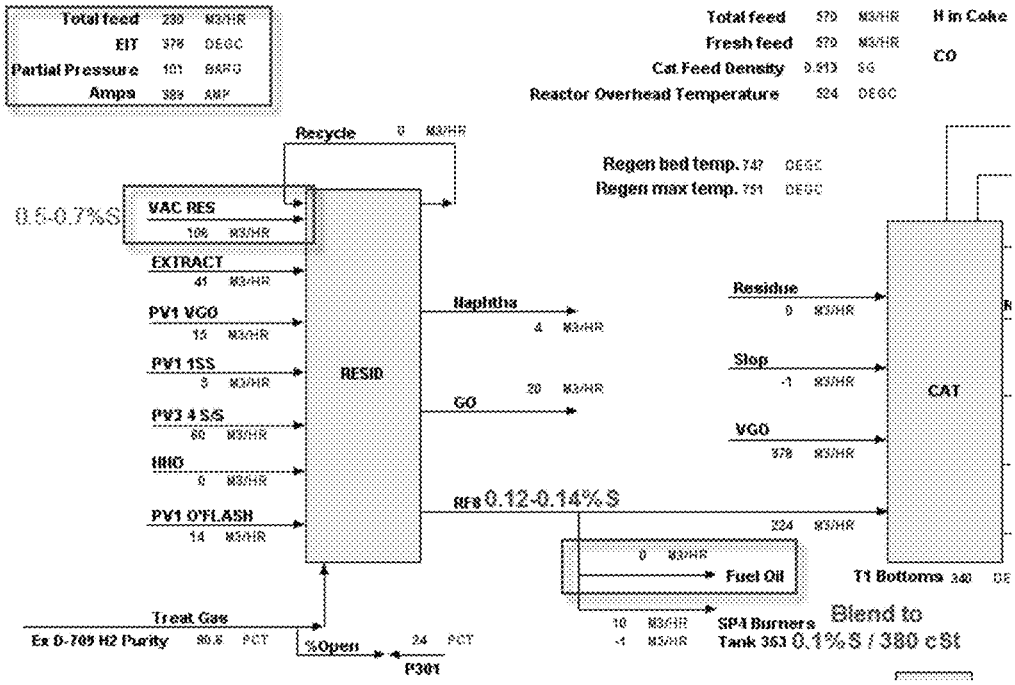
Total feed
EIT
Partial Pressure
Amps
Total feed
Fresh feed
Cat Feed Density
Reactor Overhead Temperature
H in Coke
CO
Recycle
Regen bed temp.
Regen max temp.
0.5-0.7%S
VAC RES
EXTRACT
PV1 VGO
PV1 1SS
PV3 4 S/S
HHO
PV1 O'FLASH
RESID
Naphtha
GO
RFS 0.12-0.14%S
Residue
Slop
VGO
CAT
T1 Bottoms
Fuel Oil
SP4 Burners
Tank 363
Blend to
0.1%S / 380 cSt
Treat Gas
Ex D-705 H2 Purity
%Open
P301

LOW SULFUR MARINE BUNKER FUELS AND METHODS OF MAKING SAME

CROSS-REFERENCE TO RELATED APPLICATIONS

This application claims priority to U.S. Provisional Application Ser. No. 62/087,428 filed on Dec. 4, 2014, herein incorporated by reference in its entirety.

FIELD

This invention relates generally to methods for making marine bunker fuels having relatively low sulfur content, as well as to the resulting low sulfur content fuel compositions made according to such methods.

BACKGROUND

As promulgated by the International Maritime Organization (IMO), issued as Revised MARPOL Annex VI, marine fuels will be capped globally with increasingly more stringent requirements on sulfur content. In addition, individual countries and regions are beginning to restrict sulfur level used in ships in regions known as Emission Control Areas, or ECAs.

The fuels used in global shipping are typically marine bunker fuels, for larger ships. Bunker fuels are advantageous since they are less costly than other fuels; however, they are typically composed of cracked and/or resid fuels and hence have higher sulfur levels. Meeting the lower sulfur specs for marine vessels can be conventionally accomplished through the use of distillates. However, distillate fuels typically trade at a high cost premium for a variety of reasons, not the least of which is the utility in a variety of transport applications employing Compression ignition engines. They are produced at low sulfur levels, typically significantly below the sulfur levels specified in the IMO regulations.

Those regulations specify, inter alia, a 1.0 wt % sulfur content on ECA Fuels (effective July 2010) for residual or distillate fuels, a 3.5 wt % sulfur content cap (effective January 2012), which can impact about 15% of the current residual fuel supply, a 0.1 wt % sulfur content on ECA Fuels (effective January 2015), relating mainly to hydrotreated middle distillate fuel, and a 0.5 wt % sulfur content cap (circa 2020-2025), centered mainly on distillate fitel or distillate/residual fuel mixtures. When the ECA sulfur limits and sulfur cap drops, various reactions may take place to supply low sulfur fuels. The 0.1% Sulfur ECA fuel can be challenging to supply, since shippers typically purchase tower sulfur fuel oils with properties suitable for marine applications, and at a steep price discount to distillate fuels.

Hydrotreaters in front of fluid catalytic cracking (FCC) units, commonly called CFHT, typically hydroprocess petroleum gasoils and resids to sufficiently low sulfur levels such that the product fuels are sufficient to be sold as fuel with no further treatment, or with minimal incremental hydroprocessing.

It would be advantageous to utilize a fuel high energy content, low sulfur fuels in marine applications, which fuels have conventionally included cracked distillates. Distillates can typically command a much higher value than bunker fuels. An alternative low sulfur marine bunker fuel, with the correct fuel quality characteristics, could command a high premium in the marketplace.

Indeed, there are some publications that disclose the desirability of lowering the sulfur content of marine bunker fuels. A non-exclusive list of such publications includes, for example, U.S. Pat. Nos. 4,006,076, 4,420,388, 6,187,174, 6,447,671, and 7,651,605, U.S. Patent Application Publication Nos. 2008/0093262 and 2013/0340323, PCT Publication Nos. WO 1999/057228 and WO 2009/001314, British Patent No. GB 1209967, Russian Patent No. RU 2213125, Japanese Patent No. JP 2006000726, and the following articles: *Chem. & Tech. of Fuels and Oils* (2005), 41(4), 287-91; *Ropa a Uhlie* (1979), 21(8), 433-40; *Godishnik na Visshya Khim. heski Institut, Sofiya* (1979), 25(2), 146-48; *Energy Progress* (1986), 6(1), 15-19; and *Implications Across the Supply Chain* (30 Sep. 2009) Sustainable Shipping Conference in San Francisco, Calif.

Thus, it would be desirable to find compositions (and methods for making them) in which hydrotreated and/or uncracked gasoil products could be used in marine bunker fuels, as described with reference to the invention herein.

SUMMARY

One aspect of the invention relates to a method for making a low sulfur marine bunker fuel composition with a reduced concentration of components that have been cracked, the method comprising: contacting a vacuum resid feed stream having at least about 2000 wppm, for example at least about 2000 wppm, at least about 5000 wppm, at least about 7500, or at least about 10000 wppm sulfur, with a hydrogen-containing gas in the presence of a hydrotreating catalyst under effective hydrotreating conditions in a catalytic feed hydrotreater, such that the product exhibits at most about 5000 wppm, for example at most about 1500 wppm sulfur, a pour point of at least about 20° C., and a kinematic viscosity of at least about 350 cSt at 50° C., without the product being subject to a substantial amount of cracking; and optionally blending at least a portion of the uncracked product with 0-60 vol % of other components, selected from viscosity modifiers, pour point depressants, lubricity modifiers, antioxidants, and combinations thereof, to form a marine bunker fuel composition. The resulting marine bunker fuel composition contains: (1) the uncracked product having at most about 2000 wppm, for example at most about 1500 wppm or at most about 1000 wppm sulfur; (2) no more than about 10 vol % of a first diesel boiling range hydrocarbon stream having no more than about 20 wppm sulfur; and (3) no more than about 50 vol % of a second diesel boiling range hydrocarbon stream having no more than about 10 wppm sulfur.

Another aspect of the invention relates to a low sulfur marine bunker fuel composition comprising: 40 vol % to 100 vol % of an uncracked, hydrotreated vacuum resid having at most about 5000 wppm—for example at most about 2000 wppm, at most about 1500 wppm, or at most about 1000 wppm—sulfur; and up to 60 vol % of other components, selected from viscosity modifiers, pour point depressants, lubricity modifiers, antioxidants, and combinations thereof. The low sulfur marine bunker fuel composition has: at most about 5000 wppm, for example at most about 1000 wppm sulfur; and at least one of a kinematic viscosity at about 50° C. from about 20 cSt to about 400 cSt, a density at 15° C. from about 800 kg/m$^3$ to about 1000 kg/m$^3$, and a pour point from about 20° C. to about 35° C.

Another aspect of the invention relates to a low sulfur, uncracked, hydrotreated vacuum resid having at most about 5000 wppm for example at most about 2000 wppm, at most about 1500 wppm, or at most about 1000 wppm—sulfur, a T50 of at least 600° C., a pour point of at least about 20° C., and a kinematic viscosity of at least around 100 cSt at 50° C.

BRIEF DESCRIPTION OF THE DRAWINGS

FIG. 1 shows a flow-chart outlining an exemplary process for making a low sulfur bunker fuel from a vacuum resid feed stock as described herein.

DETAILED DESCRIPTION

In one aspect of the invention, a method is described for making a low sulfur marine bunker fuel composition, while another aspect of the invention describes the low sulfur marine bunker fuel composition so made.

As used herein, the terms "marine bunker fuel", "bunker fuel", or "marine fuel" refer to fuel compositions that (1) are suitable for use in ships' engines and (2) have at least 40 vol % of a product of petroleum refining that is not distilled off in either an atmospheric or a vacuum distillation column. Further, a "marine bunker fuel" as described herein is used in contradistinction to "marine distillate fuel." A blend containing both distillate and heavier, non-distillate fuels may still be designated a "bunker fuel" if the heavy, non-distillate components make up more than 40% of the total volume of the blend.

Reduced Cracking

Advantageously, and contrary to conventional practices, the present compositions and methods focus on a reduced use/concentration of components that have been subject to a (refinery) cracking process. As used herein, the terms "substantially uncracked" or "without substantial cracking" should be understood to exclude processing the fuel by steps/stages whose primary or significant focus is cracking (e.g., FCC processes, steam cracking processes, thermal cracking processes such as visbreaking and/or coking, and the like, but typically not hydrocracking), but not to exclude steps/stages where cracking is a very minor focus or a side reaction (e.g., hydrotreating processes, aromatic saturation processes, hydrofinishing processes, and the like). Without being bound by theory, it is believed that reducing the amount of cracked stocks in a fuel composition can have an advantage of improving oxidation stability and/or ignition quality of the fuel composition (e.g., hydrocracked stocks can tend to be differentiatable from other cracked stocks in that their quality, such as in oxidation stability and/or ignition quality, can tend to be acceptable or even relatively high, perhaps due to the role that hydrogen plays in such cracking processes). As a result, conventional cracked components of marine bunker fuels such as cycle oils (e.g., light and heavy), slurry oils (i.e., the FCC bottoms), and the like, can advantageously be reduced/minimized or at least kept to a relatively low level.

Composition Sulfur Content

The low sulfur marine bunker fuel composition can advantageously meet a stricter standard than currently required for marine bunker fuels by having a maximum sulfur content of 5000 wppm, more restrictively 1500 wppm, more restrictively still 1200 wppm, or even more restrictively 1000 wppm. Although sulfur content standards for fuels are not generally given a minimum, it can often be desirable to be as close to the standard maximum as possible for any number of reasons, which may include, without limitation, that stringent sulfur standards requiring additional costly treatment can be reduced/minimized by allowing relatively high-sulfur, relatively low-value streams to be incorporated into compositions where they otherwise might not negatively affect the specifications. As such, in many embodiments meeting the more restrictive 1000 wppm specification, the low sulfur marine bunker fuels, e.g., made according to the methods disclosed herein, can exhibit a sulfur content between 900 wppm and 1000 wppm. Nevertheless, in other embodiments meeting the more restrictive 1000 wppm specification, the low sulfur marine bunker fuels, e.g., made according to the methods disclosed herein, can exhibit a sulfur content of less than about 850 wppm, for example less than about 800 wppm, less than about 750 wppm, less than about 700 wppm, less than about 650 wppm, less than about 600 wppm, less than about 550 wppm, less than about 500 wppm, less than about 450 wppm, less than about 400 wppm, less than about 350 wppm, less than about 300 wppm, less than about 250 wppm, less than about 200 wppm, less than about 150 wppm, less than about 100 wppm, less than about 75 wppm, less than about 50 wppm, less than about 30 wppm, less than about 20 wppm, less than about 15 wppm, less than about 10 wppm, less than about 8 wppm, or less than about 5 wppm. Further, in other embodiments meeting the 5000 wppm specification, the low sulfur marine bunker fuels, e.g., made according to the methods disclosed herein, can exhibit a sulfur content of at most about 4900 wppm, for example at most about 4800 wppm, at most about 4700 wppm, at most about 4600 wppm, at most about 4500 wppm, at most about 4400 wppm, at most about 4300 wppm, at most about 4200 wppm, at most about 4100 wppm, at most about 4000 wppm, at most about 3750 wppm, at most about 3500 wppm, at most about 3250 wppm, at most about 3000 wppm, at most about 2750 wppm, at most about 2500 wppm, at most about 2250 wppm, at most about 2000 wppm, at most about 1750 wppm, at most about 1500 wppm, at most about 1250 wppm, at most about 1000 wppm, at most about 750 wppm, at most about 500 wppm, at most about 250 wppm, at most about 100 wppm, at most about 75 wppm, at most about 50 wppm, most about 30 wppm, at most about 20 wppm, at most about 15 wppm, at most about 10 wppm, at most about 8 wppm, or at most about 5 wppm.

In such various other embodiments, the low sulfur marine bunker fuels, e.g., made according to the methods disclosed herein, may additionally exhibit a sulfur content of at least about 5 wppm, for example at least about 10 wppm, at least about 15 wppm, at least about 20 wppm, at least about 30 wppm, at least about 50 wppm, at least about 75 wppm, at least about 100 wppm, at least about 150 wppm, at least about 200 wppm, at least about 250 wppm, at least about 300 wppm, at least about 350 wppm, at least about 400 wppm, at least about 450 wppm, at least about 500 wppm, at least about 550 wppm, at least about 600 wppm, at least about 650 wppm, at least about 700 wppm, at least about 750 wppm, at least about 800 wppm, at least about 850 wppm, at least about 900 wppm, at least about 950 wppm, at least about 1000 wppm, at least about 1250 wppm, at least about 1500 wppm, at least about 1750 wppm, at least about 2000 wppm, at least about 2250 wppm, at least about 2500 wppm, at least about 2750 wppm, at least about 3000 wppm, at least about 3250 wppm, at least about 3500 wppm, at least about 3750 wppm, at least about 4000 wppm, at least about 4100 wppm, at least about 4200 wppm, at least about 4300 wppm, at least about 4400 wppm, at least about 4500 wppm, at least about 4600 wppm, at least about 4700 wppm, at least about 4800 wppm, or at least about 4900 wppm.

Ranges expressly disclosed include combinations of the above-enumerated upper and lower limits, e.g. 1000-500 wppm, 850-550 wppm, or 500-100 wppm.

Composition Characteristics

Additionally or alternately, the low sulfur marine bunker fuels, e.g., made according to the methods disclosed herein, can exhibit at least one of the following characteristics: a kinematic viscosity at 50° C. (according to standardized test method ISO 3104) of at least about 20 cSt, for example at least about 25 cSt, at least about 30 cSt, at least about 35 cSt, at least about 40 cSt, at least about 45 cSt, at least about 50 cSt, at least about 55 cSt, at least about 60 cSt, at least about 65 cSt, at least about 70 cSt, at least about 75 cSt, at least about 80 cSt, at least about 85 cSt, at least about 90 cSt, at least about 95 cSt, at least about 100 cSt, at least about 110 cSt, at least about 120 cSt, at least about 130 cSt, at least about 140 cSt, at least about 150 cSt, at least about 160 cSt, at least about 170 cSt, at least about 180 cSt, at least about 190 cSt, at least about 200 cSt, at least about 210 cSt, at least about 220 cSt, at least about 230 cSt, at least about 240 cSt, at least about 250 cSt, at least about 260 cSt, at least about 270 cSt, at least about 280 cSt, at least about 290 cSt, at least about 300 cSt, at least about 310 cSt, at least about 320 cSt, at least about 330 cSt, at least about 340 cSt, at least about 350 cSt, at least about 360 cSt, at least about 370 cSt, at least about 380 cSt, at least about 390 cSt, or at least about 400 cSt; a kinematic viscosity at 50° C. (according to standardized test method ISO 3104) of at most about 390 cSt, for example at most about 380 cSt, at most about 370 cSt, at most about 360 cSt, at most about 350 cSt, at most about 340 cSt, at most about 330 cSt, at most about 320 cSt, at most about 310 cSt, at most about 300 cSt, at most about 290 cSt, at most about 280 cSt, at most about 270 cSt, at most about 260 cSt, at most about 250 cSt, at most about 240 cSt, at most about 230 cSt, at most about 220 cSt, at most about 210 cSt, at most about 200 cSt, at most about 190 cSt, at most about 180 cSt, at most about 170 cSt, at most about 160 cSt, at most about 150 cSt, at most about 140 cSt, at most about 130 cSt, at most about 120 cSt, at most about 110 cSt, at most about 100 cSt, at most about 90 cSt, at most about 80 cSt, at most about 70 cSt, at most about 60 cSt, at most about 50 cSt, at most about 40 cSt, at most about 30 cSt, or at most about 25 cSt; a density at 15° C. (according to standardized test method ISO 3675 or ISO 12185) of at most about 1500 kg/m$^3$, for example at most about 1400 kg/m$^3$, at most about 1300 kg/m$^3$, at most about 1200 kg/m$^3$, at most about 1100 kg/m$^3$, at most about 1000 kg/m$^3$, at most about 990 kg/m$^3$, at most about 980 kg/m$^3$, at most about 970 kg/m$^3$, at most about 960 kg/m$^3$, at most about 950 kg/m$^3$, at most about 940 kg/m$^3$, or at most about 930 kg/m$^3$; a density at 115° C. (according to standardized test method ISO 3675 or ISO 12185) of at least about 800 kg/m$^3$, at least about 810 kg/m$^3$, at least about 820 kg/m$^3$, at least about 830 kg/m$^3$, at least about 840 kg/m$^3$, at least about 850 kg/m$^3$, at least about 860 kg/m$^3$, at least about 870 kg/m$^3$, at least about 880 kg/m$^3$, at least about 890 kg/m$^3$, or at least about 900 kg/m$^3$; a pour point (according to standardized test method ISO 3016) of at most about 45° C., for example at most about 40° C., at most about 35° C. at most about 30° C., at most about 25° C., at most about 20° C., at most about 15° C., at most about 10° C., at most about 6° C., at most about 5° C., or at most about 0° C.; a pour point (according to standardized test method ISO 3016) of at least about −50° C., for example at least about −35° C., at least about −30° C., at least about −25° C., at least about −20° C. at least about −15° C., at least about −10° C., at least about −5° C., at least about 0° C., at least about 5° C., at least about 7° C., at least about 10° C. at least about 15° C., at least about 18° C., at least about 20° C., at least about 25° C., at least about 30° C., at least about 35° C., or at least about 40° C.; a calculated carbon aromaticity index (herein "CCAI," determined according to standardized test method ISO 8217 Annex F, including Equation F.1) of about 880 or less, for example about 865 or less, about 850 or less, about 840 or less, about 830 or less, about 820 or less, about 810 or less, or about 800 or less; and a calculated carbon aromaticity index (according to standardized test method ISO 8217 Annex F, including Equation F.1) of about 780 or more, for example about 800 or more, about 810 or more, about 820 or more, about 830 or more, about 840 or more, about 850 or more, about 860 or more, about 870 or more, or about 880 or more. Ranges expressly disclosed include combinations of the above-enumerated upper and lower limits, e.g. a kinematic viscosity at 50° C. of 50-100 cSt or a pour point between −10° C. and 40° C.

Further additionally or alternately, the low sulfur marine bunker fuels, e.g., made according to the methods disclosed herein, can exhibit at least one of the following characteristics: a flash point (according to standardized test method ISO 2719) of at least about 60° C.; a hydrogen sulfide content (according to standardized test method IP 570) of at most about 2.0 mg/kg; an acid number (according to standardized test method ASTM D-664) of at most about 0.5 mg KOH per gram; a sediment content (according to standardized test method ISO 10307-1) of at most about 0.1 wt %; an oxidation stability (measured by ageing under same conditions as standardized test method ISO 12205, followed by filtration according to standard test method ISO 10307-1) of at most about 0.10 mass %; a water content (according to standardized test method ISO 3733) of at most about 0.3 vol %; and an ash content (according to standardized test method ISO 6245) of at most about 0.01 wt %.

Vacuum Resid Product

One important component of the low sulfur marine bunker fuel compositions according to the invention and/or made according to the methods disclosed herein is a substantially uncracked, hydrotreated vacuum resid product, which represents a resid feed stream (e.g., a vacuum resid) that has been (cat feed) hydrotreated through contact with a hydrogen-containing gas in the presence of a hydrotreating catalyst under effective hydrotreating conditions (in a. catalytic teed hydrotreater reactor). This substantially uncracked, hydrotreated vacuum resid product is generally the effluent from a cat feed hydrotreater (CFHT), before being sent to a refinery cracking unit (such as an FCC unit).

In the present invention, the low sulfur marine bunker fuel composition, e.g., made according to the methods disclosed herein, can be comprised of at least about 50 vol % of this uncracked, hydrotreated vacuum resid product, for example at least about 50 vol %, at least about 60 vol %, at least about 70 vol %, at least about 80 vol %, at least about 85 vol %, at least about 86 vol %, at least about 87 vol %, at least about 88 vol %, least about 89 vol %, at least about 90 vol %, at least about 91 vol %, at least about 92 vol %, at least about 93 vol %, at least about 94 vol %, at least about 95 vol %, at least about 96 vol %, at least about 97 vol %, at least about 98 vol %, at least about 99 vol %, at least about 99.9 vol %, or at least about 99.99 vol %. Additionally or alternately, the low sulfur marine bunker fuel composition, e.g., made according to the methods disclosed herein, can be comprised of 100 vol % or less of this uncracked, hydrotreated vacuum resid product, for example at most about 99.99 vol %, at most about 99.9 vol %, at most about 99 vol %, at most about 98 vol %, at most about 97 vol %, at most about 95 vol %, at most about 90 vol %, at most about 85 vol %, at most about 80 vol %, at most about 70 vol %, at most about 60 vol %, at most about 50 vol %, or at most about 40 vol %. Ranges expressly disclosed include combinations of the above-enumerated upper and lower limits, e.g. 50-99.99 vol %, 60-85 vol %, or 70-80 vol %.

Prior to being hydrotreated, the vacuum resid stream can generally have a sulfur content significantly higher than post-hydrotreatment. For instance, the pre-hydrotreated vacuum resid feed stream can have a sulfur content of at least about 2000 wppm, for example at least about 3000 wppm, at least about 5000 wppm, at least about 7500 wppm, at least about 1 wt %, ut least about 1.5 wt %, at least about 2 wt %, ut least about 2.5 wt %, or at least about 3 wt %.

After being hydrotreated and without being subject to a (refinery) cracking step, the uncracked, hydrotreated vacuum resid product can exhibit at least one of the following characteristics:

- a sulfur content of at most about 5000 wppm, for example at most about 4900 wppm, for example at most about 4800 wppm, at most about 4700 wppm, at most about 4600 wppm, at most about 4500 wppm, at most about 4400 wppm, at most about 4300 wppm, at most about 4200 wppm, at most about 4100 wppm, at most about 4000 wppm, at most about 3750 wppm, at most about 3500 wppm, at most about 3250 wppm, at most about 3000 wppm, at most about 2750 wppm, at most about 2500 wppm, at most about 2250 wppm, at most about 2000 wppm, at most about 1750 wppm, at most about 1500 wppm, at most about 1250 wppm, at most about 1000 wppm, at most about 900 wppm, at most about 800 wppm, at most about 750 wppm, at most about 700 wppm, at most about 650 wppm, at most about 600 wppm, at most about 550 wppm, at most about 500 wppm, at most about 450 wppm, at most about 400 wppm, at most about 350 wppm, at most about 300 wppm, at most about 250 wppm, at most about 200 wppm, at most about 150 wppm, at most about 100 wppm, at most about 75 wppm, at most about 50 wppm, at most about 30 wppm, at most about 20 wppm, at most about 15 wppm, at most about 10 wppm, at most about 8 wppm, or at most about 5 wppm;
- a sulfur content of at least about 5 wppm, for example at least about 10 wppm, at least about 15 wppm, at least about 20 wppm, at least about 30 wppm, at least about 50 wppm, at least about 75 wppm, at least about 100 wppm, at least about 150 wppm, at least about 200 wppm, at least about 250 wppm, at least about 300 wppm, at least about 350 wppm, at least about 400 wppm, at least about 450 wppm, at least about 500 wppm, at least about 550 wppm, at least about 600 wppm, at least about 650 wppm, at least about 700 wppm, at least about 750 wppm, at least about 800 wppm, at least about 850 wppm, at least about 900 wppm, at least about 950 wppm, at least about 1000 wppm, at least about 1250 wppm, at least about 1500 wppm, at least about 1750 wppm, at least about 2000 wppm, at least about 2250 wppm, at least about 2500 wppm, at least about 2750 wppm, at least about 3000 wppm, at least about 3250 wppm, at least about 3500 wppm, at least about 3750 wppm, at least about 4000 wppm, at least about 4100 wppm, at least about 4200 wppm, at least about 4300 wppm, at least about 4400 wppm, at least about 4500 wppm, at least about 4600 wppm, at least about 4700 wppm, at least about 4800 wppm, or at least about 4900 wppm; Ranges expressly disclosed include combinations of the above-enumerated upper and lower limits, e.g. 500-1500 wppm, 650-1000 wppm, or 800-900 wppm.
- a nitrogen content of at most about 7500 mg/kg, for example less than about 7000 mg/kg, less than about 6500 mg/kg, less than about 6000 mg/kg, less than about 5500 mg/kg, less than about 5000 mg/kg, less than about 4500 mg/kg, less than about 4000 mg/kg, less than about 3000 mg/kg, less than about 2500 mg/kg, less than about 2000 mg/kg, or less than about 1500 mg/kg.
- a nitrogen content of at least about 1000 mg/kg, for example at least about 1500 mg/kg, at least about 2000 mg/kg, at least about 2500 mg/kg, at least about 3000 mg/kg, at least about 3500 mg/kg, at least about 4000 mg/kg, at least about 4500 mg/kg, at least about 5000 mg/kg, at least about 5500 mg/kg, or at least about 6000 mg/kg. Ranges expressly disclosed include combinations of the above-enumerated upper and lower limits, e.g. 2500-7000 mg/kg, 3000-5000 mg/kg, or 4000-4500 mg/kg.
- a combined metals (Al, Ca, Na, Ni, V, and Zn) content of at most about 10 mg/kg, for example at most about 9 mg/kg, at most about 8 mg/kg, at most about 7 mg/kg, at most about 6 mg/kg, at most about 5 mg/kg, or at most about 4 mg/kg.
- a combined metals (Al, Ca, Na, Ni, V, and Zn) content of at least about 1 mg/kg, for example at least about 2 mg/kg, at least about 3 mg/kg, at least about 4 mg/kg, at least about 5 mg/kg, or at least about 6 mg/kg. Ranges expressly disclosed include combinations of the above-enumerated upper and lower limits, e.g., about 1-6 mg/kg, about 2-5 mg/kg, or about 3-4 mg/kg.
- a kinematic viscosity at 50° C. (according to standardized test method ISO 3104) of at least about 30 cSt, for example at least about 40 cSt, at least about 50 cSt, at least about 100 cSt, at least about 150 cSt, at least about 200 cSt, at least about 250 cSt, al least about 300 cSt, at least about 350 cSt, at least about 380 cSt, or at least about 400 cSt;
- a kinematic viscosity at 50° C. (according to standardized test method ISO 3104) of at most about 400 cSt, for example at most about 380 cSt, at most about 350 cSt, at most about 300 cSt, at most about 250 cSt, at most about 200 cSt, at most about 150 cSt, at most about 100 cSt, at most about 50 cSt, at most about 45 cSt, at most about 40 cSt, at most about 35 cSt, at most about 30 cSt, at most about 25 cSt, at most about 20 cSt, at most about 15 cSt, or at most about 12 cSt; Ranges expressly disclosed include combinations of the above-enumerated upper and lower limits, e.g. 50-250 cSt, 100-350 cSt, or 250-400 cSt.
- a density at 15° C. (according to standardized test method ISO 3675 or ISO 12185) of at most about 1.000 g/cm$^3$, for example at most about 0.950 g/cm$^3$, at most about 0.940 g/cm$^3$, at most about 0.935 g/cm$^3$, at most about 0.930 g/cm$^3$, at most about 0.925 g/cm$^3$, at most about 0.920 g/cm$^3$, at most about 0.915 g/cm$^3$, at most about 0.910 g/cm$^3$, at most about 0.905 g/cm$^3$, at most about 0.900 g/cm$^3$, at most about 0.895 g/cm$^3$, at most about 0.890 g/cm$^3$, at most about 0.885 g/cm$^3$, or at most about 0.880 g/cm$^3$;
- a density at about 15° C. (according to standardized test method ISO 3675 or ISO 12185) of at least about 0.870 g/cm$^3$, at least about 0.875 g/cm$^3$, at least about 0.880 g/cm$^3$, at least about 0.885 g/cm$^3$, at least about 0.890 g/cm$^3$, at least about 0.895 g/cm$^3$, at least about 0.900 g/cm$^3$, at least about 0.905 g/cm$^3$, at least about 0.910 g/cm$^3$, at least about 0.915 g/cm$^3$, at least about 0.920 g/cm$^3$, at least about 0.925 g/cm$^3$, at least about 0.930 g/cm$^3$, or at least about 0.935 g/cm$^3$; Ranges expressly disclosed include combinations of the above-enumerated upper and lower limits, e.g. 0.870-0.925 g/cm$^3$, 0.890-0.930 g/cm$^3$, or 0.910-1.000 g/cm$^3$.

a pour point (according to standardized test method ISO 3010 of at most about 45° C., for example at most about 40° C., at most about 35° C., at most about 30° C., at most about 25° C., at most about 20° C., at most about 15° C., at most about 10° C., at most about 6° C., at most about 5° C., or at most about 0° C.;

a pour point (according to standardized test method ISO 3016) of at least −50° C., for example at least −35° C., at least −30° C., at least −25° C., at least −20° C., at least −15° C., at least −10° C., at least −5° C., at least about 0° C., at least about 5° C., at least about 7° C., at least about 10° C., at least about 15° C., at least about 20° C., at least about 25° C., at least about 30° C., at least about 35° C., or at least about 40° C.; Ranges expressly disclosed include combinations of the above-enumerated upper and lower limits, e.g. −15-1.5° C., 10-30° C., or 20-40° C.

a calculated carbon aromaticity index (according to standardized test method ISO 8217 Annex F, including Equation F.1) of about 880 or less, for example about 865 or less, about 850 or less, about 840 or less, about 830 or less, about 820 or less, about 810 or less, or about 800 or less; and a calculated carbon aromaticity index (according to standardized test method ISO 8217 Annex F, including Equation F.1) of about 780 or more, for example about 800 or more, about 810 or more, about 820 or more, about 830 or more, about 840 or more, about 850 or more, about 860 or more, about 870 or more, or about 880 or more; Ranges expressly disclosed include combinations of the above-enumerated upper and lower limits, e.g. 780-880, 800-865, or 810-840.

As used herein, a "T[num]" boiling point of a composition represents the temperature required to boil at least [num] percent by weight of that composition. For example, the temperature required to boil at least about 25 wt % of a feed is referred to herein as a "T25" boiling point. All boiling temperatures used herein refer to the temperature at 1 atm pressure. The basic test method of determining the boiling points or ranges of any feedstock, any fuel component, and/or any fuel composition produced according to this invention, can be performed according to standardized test method IP 480 and/or by batch distillation according to ASTM D86-09e1.

After being hydrotreated and without being subject to a (refinery) cracking step, the uncracked, hydrotreated vacuum resid product can optionally also exhibit at least one of the following boiling point characteristics:

an initial boiling point (IBP) of at least about 250° C., for example at least about 255° C., at least about 260° C., at least about 265° C., at least about 270° C., at least about 275° C., at least about 280° C., at least about 285° C., at least about 290° C., at least about 295° C., at least about 300° C., at least about 305° C., or at least about 310° C.;

an IBP of at most about 315° C., for example at most about 310° C., at most about 305° C., at most about 300° C., at most about 295° C., at most about 290° C., at most about 285° C., at most about 280° C., at most about 275° C., at most about 270° C., or at most about 265° C.; ranges expressly disclosed include combinations of the above-enumerated upper and lower limits, e.g. 280-310° C., 290-300° C., or 300-310° C.

a T5 boiling point of at least about 300° C., at least about 305° C., at least about 310° C., at least about 315° C., at least about 320° C., at least about 325° C., at least about 330° C., at least about 335° C., at least about 340° C., at least about 345° C., at least about 350° C., at least about 355° C., at least about 360° C., at least about 365° C., at least about 370° C., at least about 375° C., or at least about 380° C.;

a T5 boiling point of at most about 370° C., for example at most about 365° C., at most about 360° C., at most about 355° C., at most about 350° C., at most about 345° C., at most about 340° C., at most about 335° C., at most about 330° C., at most about 325° C., at most about 320° C., at most about 315° C., at most about 310° C., at most about 305° C., or at most about 300° C.; Ranges expressly disclosed include combinations of the above-enumerated upper and lower limits, e.g., 300-370° C., 350-360° C., or 345-365° C.

a T50 boiling point of at least about 450° C., for example at least about 455° C., at least about 460° C., at least about 465° C., at least about 470° C., at least about 475° C., at least about 480° C., at least about 485° C., at least about 490° C. at least about 495° C., at least about 500° C., at least about 505° C., at least about 510° C., at least about 515° C., or at least about 520° C.;

a T50 boiling point of at most about 535° C., for example at most about 530° C., at most about 525° C., at most about 520° C., at most about 515° C., at most about 510° C., at most about 505° C., at most about 500° C., at most about 495° C., at most about 490° C., at most about 485° C., at most about 480° C., at most about 475° C., at most about 470° C., or at most about 465° C.; Ranges expressly disclosed include combinations of the above-enumerated upper and lower limits, e.g. 450-520° C., 480-500° C., or 470-485° C.

a T95 boiling point of at least about 670° C., for example at least about 675° C., at least about 680° C., at least about 685° C., at least about 690° C., at least about 695° C., at least about 700° C., at least about 705° C., at least about 710° C., at least about 715° C., at least about 720° C., at least about 735° C., at least about 740° C., at least about 745° C., at least about 750° C., at least about 755° C., or at least about 760° C.;

a T95 boiling point of at most about 755° C., for example at most about 750° C., at most about 745° C., at most about 740° C., at most about 735° C., at most about 730° C., at most about 725° C., at most about 720° C., at most about 715° C., at most about 710° C., at most about 705° C., at most about 700° C., at most about 695° C., at most about 690° C., at most about 685° C., at most about 680° C., or at most about 675° C.; Ranges expressly disclosed include combinations of the above-enumerated upper and lower limits, e.g. 690-760° C., 630-680° C., or 750-760° C.

a final boiling point (FBP) of at least about 760° C., for example at least about 765° C., at least about 770° C., at least about 775° C., at least about 780° C., at least about 785° C., at least about 790° C., at least about 795° C., at least about 800° C., at least about 805° C., at least about 810° C., at least about 815° C., at least about 820° C., at least about 825° C., at least about 830° C., at least about 835° C., or at least about 840° C.; and an FBP of at most about 845° C., for example at most about 840° C., at most about 835° C., at most about 830° C., at most about 825° C., at most about 820° C., at most about 815° C., at most about 810° C., at most about 805° C., at most about 800° C., at most about 795° C., at most about 790° C., at most about 785° C., at most about 780° C., at most about 775° C., at most about 770° C., or at most about 765° C.; Ranges expressly disclosed include combinations of the above-enumerated upper and lower limits, e.g. 860-740° C., 790-730° C., or 800-810° C.

Additionally or alternatively, the untracked, hydrotreated vacuum resid product can exhibit at least one of the following characteristics: a flash point (according to standardized test method ISO 2719) of at least about 60° C.; a hydrogen sulfide content (according to standardized test method IP 570) of at most about 2.0 mg/kg; an acid number (according to standardized test method ASTM D-664) of at most about 0.5 mg KOH per gram; a sediment content (according to standardized test method ISO 10307-1) of at most about 0.1 wt %; an oxidation stability (measured by ageing under same conditions as standardized test method ISO 12205, followed by filtration according to standard test method ISO 10307-1) of at most about 0.10 mass %; a water content (according to standardized test method ISO 3733) of at most about 0.3 vol %; and an ash content (according to standardized test method ISO 6245) of at most about 0.01 wt %.

Other Components of the Composition

When there are other components in the low sulfur marine bunker fuel composition, e.g., made according to the methods disclosed herein, aside from the untracked, hydrotreated vacuum resid product, there can be up to 70 vol % of other components, individually or in total, for example up to 65 vol %, up to 60 vol %, up to 55 vol %, up to 50 vol %, up to 45 vol %, up to 40 vol %, up to 35 vol %, up to 30 vol %, up to 25 vol %, up to 20 vol %, up to 15 vol %, up to 10 vol %, up to 7.5 vol %, up to 5 vol %, up to 3 vol %, up to 2 vol %, up to 1 vol %, up to 0.8 vol %, up to 0.5 vol %, up to 0.3 vol %, up to 0.2 vol %, up to 1000 vppm, up to 750 vppm, up to 500 vppm, up to 300 vppm, or up to 100 vppm.

Additionally or alternatively, when there are other components in the low sulfur marine bunker fuel, e.g., made according to the methods disclosed herein, aside from the uncracked, hydrotreated vacuum resid product, there can be at least about 100 wppm of other components, individually or in total, for example at least about 300 vppm, at least about 500 vppm, at least about 750 vppm, at least about 1000 vppm, at least about 0.2 vol %, at least about 0.3 vol %, at least about 0.5 vol %, at least about 0.8 vol %, at least about 1 vol %, at least about 2 vol %, at least about 3 vol %, at least about 5 vol %, at least about 7.5 vol %, at least about 10 vol %, at least about 15 vol %, at least about 20 vol %, at least about 25 vol %, at least about 30 vol %, at least about 35 vol %, at least about 40 vol %, at least about 45 vol %, at least about 50 vol %, at least about 55 vol %, at least about 60 vol %, or at least about 65 vol %. Examples of such other components can include, but are not limited to, viscosity modifiers, pour point depressants, lubricity modifiers, antioxidants, and combinations thereof. Other examples of such other components can include, but are not limited to, distillate boiling range components such as straight-run atmospheric (fractionated) distillate streams, straight-run vacuum (fractionated) distillate streams, hydrocracked distillate streams, and the like, and combinations thereof. Such distillate boiling range components can behave as viscosity modifiers, as pour point depressants, as lubricity modifiers, as some combination thereof, or even in some other functional capacity in the aforementioned low sulfur marine bunker fuel.

Examples of pour point depressants can include, but are not limited to, oligomers/copolymers of ethylene and one or more comonomers (such as those commercially available from Infineum, e.g., of Linden, N.J.), which may optionally be modified post-polymerization to be at least partially functionalized (e.g., to exhibit oxygen-containing and/or nitrogen-containing functional groups not native to each respective comonomer). Depending upon the physicochemical nature of the uncracked, hydrotreated vacuum resid product and/or the low sulfur marine bunker fuel composition, e.g., made according to the methods disclosed herein, in some embodiments, the oligomers/copolymers can have a number average molecular weight ($M_n$) of about 500 g/mol or greater, for example about 750 g/mol or greater, about 1000 g/mol or greater, about 1500 g/mol or greater, about 2000 g/mol or greater, about 2500 g/mol or greater, about 3000 g/mol or greater, about 4000 g/mol or greater, about 5000 g/mol or greater, about 7500 g/mol or greater, or about 10000 g/mol or greater. Additionally or alternately in such embodiments, the oligomers/copolymers can have an $M_n$ of about 25000 g/mol or less, for example about 20000 g/mol or less, about 15000 g/mol or less, about 10000 g/mol or less, about 7500 g/mol or less, about 5000 g/mol or less, about 4000 g/mol or less, about 3000 g/mol or less, about 2500 g/mol or less, about 2000 g/mol or less, about 1500 g/mol or less, or about 1000 g/mol or less. The amount of pour point depressants, when desired to be added to the low sulfur marine bunker fuel composition, e.g., made according to the methods disclosed herein, can include any amount effective to reduce the pour point to a desired level, such as within the general ranges described hereinabove.

In some embodiments, in addition to an uncracked, hydrotreated vacuum resid product, the low sulfur marine bunker fuel, e.g., made according to the methods disclosed herein, can comprise up to 15 vol % (for example, up to 10 vol %, up to 7.5 vol %, or up to 5 vol %; additionally or alternately, at least about 1 vol %, for example at least about 3 vol %, at least about 5 vol %, at least about 7.5 vol %, or at least about 10 vol %) of slurry oil, fractionated (but otherwise untreated) crude oil, or a combination thereof.

In some embodiments, up to about 50 vol % of the low sulfur marine bunker fuel composition can be diesel additives. These diesel additives can be cracked or uncracked, or can be a blend of cracked and uncracked diesel fuels. In particular embodiments, the diesel additives can include a first diesel additive and a second diesel additive, also described herein as a "first diesel boiling hydrocarbon stream" and a "second diesel boiling hydrocarbon stream." Diesel fuels typically boil in the range of about 180° C. to about 360° C.

The first diesel additive can be a low-sulfur, hydrotreated diesel additive, having no more than 30 wppm sulfur, for example no more than about 25 wppm, no more than about 20 wppm, no more than about 15 wppm, no more than about 10 wppm, or no more than about 5 wppm sulfur. In some embodiments, the first diesel additive can provide up to about 40 vol % of the total fuel composition, for example up to about 35 vol %, up to about 30 vol %, up to about 25 vol %, up to about 20 vol %, up to about 15 vol %, up to about 10 vol %, or up to about 5 vol %.

The second diesel additive can be a low-sulfur, hydrotreated diesel additive, having no more than 20 wppm sulfur, for example no more than about 15 wppm, no more than about 10 wppm, no more than about 5 wppm, no more than about 3 wppm, or no more than about 2 wppm sulfur. In some embodiments, the second diesel additive can provide up to about 50 vol % of the total fuel composition, for example up to about 45 vol %, up to about 40 vol %, up to about 35 vol %, up to about 30 vol %, up to about 25 vol %, up to about 20 vol %, up to about 15 vol %, up to about 10 vol %, or up to about 5 vol %.

Hydrotreating a Vacuum Resid Feed Stream

The (cat feed) hydrotreatment of the vacuum resid feed stream to attain the uncracked, hydrotreated vacuum resid product can be accomplished in any suitable reactor or combination of reactors in a single stage or in multiple stages. This hydrotreatment step typically includes exposure of the feed stream to a hydrotreating catalyst under effective hydrotreating conditions. The hydrotreating catalyst can comprise any suitable hydrotreating catalyst, e.g., a catalyst comprising at least one Group VIII metal (for example selected from Ni, Co, and a combination thereof) and at least one Group VIB metal (for example selected from Mo, W, and a combination thereof), optionally including a suitable support and/or filler material (e.g., comprising alumina, silica, titania, zirconia, or a combination thereof). The Group VIII metal of a hydrotreating catalyst can be present in an amount ranging from about 0.1 wt % to about 20 wt %, for example from about 1 wt % to about 12 wt %. The Group VIB metal can be present in an amount ranging from about 1 wt to about 50 wt %, for example from about 2 wt % to about 2.0 wt % or from about 5 wt % to about 30 wt %. The hydrotreating catalyst according to aspects of this invention can be a bulk catalyst or a supported catalyst. All weight percents of metals are given in oxide form on support. By "on support" is meant that the percents are based on the weight of the support. For example, if the support were to weigh 100 grams, then 20 wt % Group VIII metal would mean that 20 grams of Group VIII metal oxide is on the support. It is within the scope of the present invention that more than one type of hydrotreating catalyst be used in the same reaction vessel.

Techniques for producing supported catalysts are well known in the art. Techniques for producing bulk metal catalyst particles are known and have been previously described, for example in U.S. Pat. No. 6,162,350, which is hereby incorporated by reference. Bulk metal catalyst particles can be made via methods where all of the metal catalyst precursors are in solution, or via methods where at least one of the precursors is in at least partly in solid form, optionally but preferably while at least another one of the precursors is provided only in a solution form. Providing a metal precursor at least partly in solid form can be achieved, for example, by providing a solution of the metal precursor that also includes solid and/or precipitated metal in the solution, such as in the form of suspended particles. By way of illustration, some examples of suitable hydrotreating catalysts are described in one or more of U.S. Pat. Nos. 6,156,695, 6,162,350, 6,299,760, 6,582,590, 6,712,955, 6,783,663, 6,863,803, 6,929,738, 7,229,548, 7,288,182, 7,410,924, and 7,544,632, U.S. Patent Application Publication Nos. 2005/0277545, 2006/0060502, 2007/0084754, and 2008/0132407, and International Publication Nos. WO 04/007646, WO 2007/084437, WO 2007/084438, WO 2007/084439, and WO 2007/084471, inter alia.

In certain embodiments, the hydrotreating catalysts used in the practice of the present invention are supported catalysts. Any suitable refractory catalyst support material—e.g. metallic oxide support materials—can be used as supports for the catalyst. Non-limiting examples of suitable support materials can include: alumina, silica, titania, calcium oxide, strontium oxide, barium oxide, thermally (at least partially) decomposed organic media, zirconia, magnesia, diatomaceous earth, lanthanide oxides (including cerium oxide, lanthanum oxide, neodymium oxide, yttrium oxide, and praseodymium oxide), chromia, thorium oxide, urania, niobia, tantala, tin oxide, zinc oxide, corresponding phosphates, and the like, and combinations thereof. In certain embodiments, the supports can include alumina, silica, and silica-alumina. It is to be understood that the support material can also contain small amounts of contaminants, such as Fe, sulfates, and various metal oxides, that can be introduced during the preparation of the support material. These contaminants are typically present in the raw materials used to prepare the support and can preferably be present in amounts less than about 1 wt %, based on the total weight of the support. It is preferred that the support material be substantially free of such contaminants. In another embodiment, about 0 wt % to about 5 wt %, for example from about 0.5 wt % to about 4 wt % or from about 1 wt % to about 3 wt % of an additive can be present in the support. The additive can be selected from the group consisting of phosphorus and metals or metal oxides from Group IA (alkali metals) of the Periodic Table of the Elements.

The catalysts in the hydrotreating step(s) according to the invention may optionally contain additional components, such as other transition metals (e.g., Group V metals such as niobium), rare earth metals, organic ligands (e.g., as added or as precursors left over from oxidation and/or sulfidization steps), phosphorus compounds, boron compounds, fluorine-containing compounds, silicon-containing compounds, promoters, binders, fillers, or like agents, or combinations thereof. The Groups referred to herein reference Groups of the CAS Version as found in the Periodic Table of the Elements in Hawley's Condensed Chemical Dictionary, $13^{th}$ Edition.

In some embodiments, the effective hydrotreating conditions can comprise one or more of: a weight average bed temperature (WABT) from about 550° F. (about 288° C.) to about 800° F. (about 427° C.); a total pressure from about 300 psig (about 2.1 MPag) to about 3000 psig (about 20.7 MPag), for example from about 700 psig (about 4.8 MPag) to about 2200 psig (about 15.3 MPag), e.g. about 150 bar (about 15.1 MPag); an LHSV from about 0.1 $hr^{-1}$ to about 20 $hr^{-1}$, for example from about 0.2 $hr^{-1}$ to about 10 $hr^{-1}$; and a hydrogen treat gas rate from about 500 scf/bbl (about 85 $Nm^3/m^3$) to about 10000 scf/bbl (about 1700 $Nm^3/m^3$), for example from about 750 scf/bbl (about 130 $Nm^3/m^3$) to about 7000 scf/bbl (about 1200 $Nm^3/m^3$) or from about 1000 scf/bbl (about 170 $Nm^3/m^3$) to about 5000 scf/bbl (about 850 $Nm^3/m^3$).

Hydrogen-containing (treat) gas, as referred to herein, can be either pure hydrogen or a gas containing hydrogen, in an amount at least sufficient for the intended reaction purpose(s), optionally in addition to one or more other gases (e.g., nitrogen, light hydrocarbons such as methane, and the like, and combinations thereof) that generally do not adversely interfere with or affect either the reactions or the products. Impurities, such as $H_2S$ and $NH_3$, are typically undesirable and would typically be removed from, or reduced to desirably low levels in, the treat gas before it is conducted to the reactor stage(s). The treat gas stream introduced into a reaction stage can preferably contain at least about 50 vol % hydrogen, for example at least about 75 vol %, at least about 80 vol %, at least about 85 vol %, or at least about 90 vol %.

The feedstock provided to the hydrotreating step according to the invention can, in some embodiments, comprise both a vacuum resid feed portion and a biofeed (lipid material) portion. In one embodiment, the lipid material and vacuum resid feed can be mixed together prior to the hydrotreating step. In another embodiment, the lipid material and vacuum resid feed can be provided as separate streams into one or more appropriate reactors.

The term "lipid material" as used according to the invention is a composition comprised of biological materials. Generally, these biological materials include vegetable fats/oils, animal fats/oils, fish oils, pyrolysis oils, and algae lipids/oils, as well as components of such materials. More specifically, the lipid material includes one or more type of lipid compounds. Lipid compounds are typically biological compounds that are insoluble in water, but soluble in non-polar (or fat) solvents, examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used in accordance with this invention include, but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil and rice bran oil.

Vegetable oils as referred to herein can also include processed vegetable oil material. Non-limiting examples of processed vegetable oil material include fatty acids fatty acid alkyl esters. Alkyl esters typically include $C_1$-$C_5$ alkyl esters. One or more of methyl, ethyl, and propyl esters are preferred.

Examples of animal fats that can be used in accordance with the invention include, but are not limited to, beef fat (tallow), hog fat (lard), turkey fat, fish fat/oil, and chicken fat. The animal fats can be obtained from any suitable source including restaurants and meat production facilities.

Animal fats as referred to herein also include processed animal fat material. Non-limiting examples of processed animal fat material include fatty acids and fatty acid alkyl esters. Alkyl esters typically include $C_1$-$C_5$ alkyl esters. One or more of methyl, ethyl, and propyl esters are preferred.

Algae oils or lipids are typically contained in algae in the form of membrane components, storage products, and metabollites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the biomass itself.

Algal sources for algae oils include, but are not limited to, unicellular and multicellular algae. Examples of such algae include a rhodophyte, chlorophyte, heterokontophyte, tribophyte, glaucophyte, chlorarachniophyte, euglenoid, haptophyte, cryptomonad, dinoflagellum, phytoplankton, and the like, and combinations thereof. In one embodiment, algae can be of the classes Chlorophyceae and/or Haptophyta. Specific species can include, but are not limited to, *Neochloris oleoabundans, Scenedesmus dimorphus, Euglena gracills, Phaeodactylum tricornutuni, Pleurochrysis carterae, Pryintlesium parvum, Tetrasehnis chui*, and *Chlamydonionas reinhardtii.*

The lipid material portion of the feedstock, when present, can be comprised of triglycerides, fatty acid alkyl esters, or preferably combinations thereof. In one embodiment where lipid material is present, the feedstock can include at least about 0.05 wt % lipid material, based on total weight of the feedstock provided for processing into fuel, preferably at least about 0.5 wt %, for example at least about 1 wt %, at least about 2 wt %, or at least about 4 wt %. Additionally or alternately, where lipid material is present, the feedstock can include not more than about 40 wt % lipid material, based on total weight of the feedstock, preferably not more than about 30 wt %, for example not more than about 20 wt %, or not more than about 10 wt %.

In embodiments where lipid material is present, the feedstock can include not greater than about 99.9 wt % mineral oil, for example not greater than about 99.8 wt %, not greater than about 99.7 wt %, not greater than about 99.5 wt %, not greater than about 99 wt %, not greater than about 98 wt %, not greater than about 97 wt %, not greater than about 95 wt %, not greater than about 90 wt %, not greater than about 85 wt % mineral oil, or not greater than about 80 wt %, based on total weight of the feedstock. Additionally or alternately, in embodiments where lipid material is present, the feedstock can include at least about 50 wt % mineral oil, for example at least about 60 wt %, at least about 70 wt %, at least about 75 wt %, or at least about 80 wt % mineral oil, based on total weight of the feedstock.

In some embodiments where lipid material is present, the lipid material can comprise a fatty acid alkyl ester, such as, but not limited to, fatty acid methyl esters (FAME), fatty acid ethyl esters (FAEE), and/or fatty acid propyl esters.

Blending the Hydrotreated Vacuum Resid

Tools and processes for blending fuel components are well known in the art. See, for example, U.S. Pat. Nos. 3,522,169, 4,601,303, 4,677,567. Once the vacuum resid, e.g., made according to the methods disclosed herein, has been hydrotreated, it can be blended as desired with any of a variety of additives including (e.g.) viscosity modifiers, pour point depressants, lubricity modifiers, antioxidants, and combinations thereof. The uncracked, hydrotreated vacuum resid can be blended with a first and a second low sulfur diesel boiling range hydrocarbon stream as necessary to produce a marine bunker fuel composition having a desired set of marine fuel specifications.

Further Embodiments

Additionally or alternately, the present invention can include one or more of the following embodiments.

Embodiment 1

A method for producing a low-sulfur bunker fuel composition, the method comprising: hydrotreating a vacuum resid feed stream with hydrogen in the presence of a hydrotreating catalyst to reduce sulfur to no more than about 1500 parts per million (ppm) without substantially cracking the vacuum resid; and blending the hydrotreated vacuum resid with no more than about 10 vol % of a first diesel boiling range hydrocarbon stream and no more than about 40 vol % of a second diesel boiling range hydrocarbon stream, wherein the vacuum resid feed stream has about 1000 to about 10000 ppm sulfur, the first diesel boiling range hydrocarbon stream has no more than about 20 ppm sulfur, and the second diesel boiling range hydrocarbon stream has no more than about 10 ppm sulfur.

Embodiment 2

The method of embodiment 1, wherein the vacuum resid feed stream has about 6000 to about 10000 ppm sulfur.

Embodiment 3

The method of either embodiment 1 or embodiment 2, wherein the vacuum resid feed stream has about 6000 to about 8000 ppm sulfur.

Embodiment 4

The method of any one of the previous embodiments, wherein the sulfur of the hydrotreated vacuum resid is reduced to no more than about 1400 ppm.

Embodiment 5

The method of any one of the previous embodiments, wherein the sulfur of the hydrotreated vacuum resid is reduced to no more than about 1300 ppm.

Embodiment 6

The method of any one of the previous embodiments, wherein the sulfur of the hydrotreated vacuum resid is reduced to no more than about 1200 ppm.

Embodiment 7

The method of any one of the previous embodiments, wherein the sulfur of the hydrotreated vacuum resid is reduced to no more than about 1000 ppm.

Embodiment 8

The method of any one of the previous embodiments, wherein the hydrotreated vacuum resid is blended with no more than about 25 vol % of the second diesel boiling range hydrocarbon stream.

Embodiment 9

The method of any one of the previous embodiments, wherein the hydrotreated vacuum resid is blended with no more than about 20 vol % of the second diesel boiling range hydrocarbon stream.

Embodiment 10

The method of any one of the previous embodiments, wherein the hydrotreated vacuum resid is blended with no more than about 15 vol % of the second diesel boiling range hydrocarbon stream.

Embodiment 11

The method of any one of the previous embodiments, wherein the hydrotreated vacuum resid is blended with no more than about 7.5 vol % of the first diesel boiling range hydrocarbon stream.

Embodiment 12

The method of any one of the previous embodiments, wherein the hydrotreated vacuum resid is blended with no more than about 5 vol % of the first diesel boiling range hydrocarbon stream.

Embodiment 13

The method of any one of the previous embodiments, wherein the vacuum resid feed stream is hydrotreated under at least 150 bar of pressure.

Embodiment 14

A low sulfur bunker fuel composition comprising: about 50 vol % to about 100 vol % of an uncracked, hydrotreated vacuum resid having at most about 1500 ppm sulfur and a kinematic viscosity of at least about 350 cSt at 50° C.; up to about 10 vol % of a first diesel boiling range hydrocarbon stream; and up to about 40 vol % of a second diesel boiling range hydrocarbon stream, wherein the first diesel boiling range hydrocarbon stream has no more than about 20 ppm sulfur, and the second diesel boiling range hydrocarbon stream has no more than about 10 ppm sulfur, and wherein the fuel composition has one or more properties selected from the group consisting of: (1) a kinematic viscosity of about 20 cSt to about 100 cSt at 50° C.; (2) a density of about 800 kg/m$^3$ to 1000 kg/in$^3$ at 15° C.; (3) and a pour point of 25° C. to 35° C.

Embodiment 15

The fuel composition of embodiment 14, wherein the composition has a kinematic viscosity of about 380 cSt at 50° C.

Embodiment 16

The fuel composition of either embodiment 14 or embodiment 15, wherein the composition has a total metal content of no more than 6 mg/kg.

Embodiment 17

The fuel composition of any one of embodiments 14-16, wherein the composition has a total metal content of no less than 3 mg/kg.

Embodiment 18

The fuel composition of any one of embodiments 14-17, wherein the composition has less than 1200 ppm sulfur.

Embodiment 19

The fuel composition of any one of embodiments 14-18, wherein the composition has less than 1000 ppm sulfur.

Embodiment 20

The fuel composition of any one of embodiments 14-19, wherein the composition has less than 900 ppm sulfur.

Embodiment 21

The fuel composition of any one of embodiments 14-20, wherein the composition has less than 850 ppm sulfur.

Embodiment 22

The fuel composition of any one of embodiments 14-21, wherein the composition has less than 800 ppm sulfur.

Embodiment 23

The fuel composition of any one of embodiments 14-22, wherein the composition has less than 500 ppm sulfur.

Embodiment 24

The fuel composition of any one of embodiments 14-23, wherein the composition has at least 500 ppm sulfur.

Embodiment 25

The fuel composition of any one of embodiments 14-24, comprising no more than about 25 vol % of the second diesel boiling range hydrocarbon stream.

Embodiment 26

The fuel composition of any one of embodiments 14-25, comprising no more than about 20 vol % of the second diesel boiling range hydrocarbon stream.

Embodiment 27

The fuel composition of any one of embodiments 14-26, comprising no more than about 15 vol % of the second diesel boiling range hydrocarbon stream.

Embodiment 28

The fuel composition of any one of embodiments 14-27, comprising no more than about 10 vol % of the second diesel boiling range hydrocarbon stream.

Embodiment 29

The fuel composition of any one of embodiments 14-28, comprising no more than about 7.5 vol % of the first diesel boiling range hydrocarbon stream.

Embodiment 30

The fuel composition of any one of embodiments 14-29, comprising no more than about 5 vol % of the first diesel boiling range hydrocarbon stream.

Embodiment 31

The fuel composition of any one of embodiments 14-30, wherein the uncracked, hydrotreated vacuum resid provides no less than 60 vol % of the composition.

Embodiment 32

The fuel composition of any one of embodiments 14-31, wherein the uncracked, hydrotreated vacuum resid provides no less than 65 vol % of the composition.

Embodiment 33

The fuel composition of any one of embodiments 14-32, wherein the uncracked, hydrotreated vacuum resid provides no less than 70 vol % of the composition.

Embodiment 34

The fuel composition of any one of embodiments 14-33, wherein the uncracked, hydrotreated vacuum resid provides no less than 80 vol % of the composition.

Embodiment 35

The fuel composition of any one of embodiments 14-34, wherein the uncracked, hydrotreated vacuum resid provides no less than 90 vol % of the composition.

Embodiment 36

An uncracked vacuum resid having a T50 of at least 600° C. and no more than about 1500 ppm sulfur.

Embodiment 37

The uncracked vacuum resid of embodiment 36, having no more than about 1300 ppm sulfur.

Embodiment 38

The uncracked vacuum resid of either embodiment 36 or embodiment 37, having no more than about 1200 ppm sulfur.

Embodiment 39

The uncracked vacuum resid of any one of embodiments 37-38, having no more than about 1000 ppm sulfur.

Embodiment 40

The uncracked vacuum resid of any one of embodiments 37-39, having no more than about 800 ppm sulfur.

Embodiment 41

The uncracked vacuum resid of any one of embodiments 37-40, having no more than about 500 ppm sulfur.

Embodiment 42

The uncracked vacuum resid of any one of embodiments 37-41, having at least about 500 ppm sulfur.

Embodiment 43

The uncracked vacuum resid of any one of embodiments 37-42, having a total metal content of no more than 6 mg/kg.

Embodiment 44

The uncracked vacuum resid of any one of embodiments 37-43, having a total metal content of no less than 3 mg/kg.

Embodiment 45

The uncracked vacuum resid of any one of embodiments 37-44, having no more than about 6000 mg/kg nitrogen.

EXAMPLES

The following examples are merely illustrative, and do not limit this disclosure in any way.

Example 1 Hydrotreating and Blending Process

In prophetic Example 1 (see FIG. 1), a high sulfur (e.g., about 0.5 to about 0.8 wt %) vacuum resid, having been fractionated from a crude oil and exhibiting the properties disclosed in Table 1 below, is ted at a rate of ~106 $m^3$/hr into a (cat feed) hydrotreating unit that is loaded with a commercially available alumina-supported Group VIB/Group VIII (e.g., NiMo) hydrotreating catalyst.

In the hydrotreating unit, the vacuum resid is both hydrotreated to remove most (e.g., at least about 80 wt %, for example at least about 90 wt % or at least about 95 wt %) of the sulfur content. The treatment employs a stream of gas that is ~80.6% hydrogen. The treatment occurs under e.g. ~101 bar pressure and at e.g. ~378° C. The EIT may be between about 315° C. and about 455° C., for example between about 360° C. and 395° C. The total pressure my range from about 90 bar to about 150 bar, for example about 120 bar.

The product from the hydrotreating unit is an uncracked, hydrotreated vacuum resid product (details in Table 4 below), prior to being fed to an FCC unit. At the end of the hydrotreatment process, the resulting uncracked vacuum resid contains between about 0.12 wt % and about 0.14 wt % sulfur. At least a portion of this uncracked, hydrotreated vacuum resid product can be diverted from the FCC unit to be blended with a combination of a first diesel additive feed (Table 2) and a second diesel additive feed (Table 3) to yield a bunker fuel composition with ~1000 wppm sulfur and a kinematic viscosity at 50° C. of ~380 cSt. At least 40% by volume, and up to 100% by volume, of the marine bunker fuel composition can be comprised of the uncracked, hydrotreated vacuum resid product.

TABLE 1

Typical (exemplary) vaccum resid feed

| | | |
|---|---|---|
| Sulfur, wt % | ~0.5 to ~0.8 | (~0.65) |
| Nitrogen, wppm | ~3000-3700 | (~3375) |
| Density at 15° C., kg/$m^3$ | ~900 to ~1000 | ~962 |
| Viscosity at 50° C., cSt | ~400 to ~550 | (~497) |
| Conradson carbon residue, wt % | ~4-7 | (~6.4) |
| Initial Boiling Point (IBP), ° C. | ~265-360 | (~305) |
| T5 Boiling Point, ° C. | ~360-410 | (~378) |
| T10 Boiling Point, ° C. | ~410-430 | (~397) |
| T20 Boiling Point, ° C. | ~430-455 | (~421) |
| T30 Boiling Point, ° C. | ~455-465 | (~41) |
| T40 Boiling Point, ° C. | ~465-490 | (~466) |
| T50 Boiling Point, ° C. | ~490-520 | (~504) |
| T60 Boiling Point, ° C. | ~520-560 | (~551) |
| T95 Boiling Point, ° C. | ~560-785 | (~758) |
| Final Boiling Point (FBP), ° C. | ~785-840 | (~801) |

TABLE 2

Typical (exemplary) first diesel additive feed

| | | |
|---|---|---|
| Density at 15° C., kg/$m^3$ | ~800-900 | (~866.3) |
| Cloud point, ° C. | ~5-8 | (~6.8) |
| T50 Boiling Point, ° C. | ~280-350 | (~321.9) |
| Flash point, ° C. | ~70-110 | (~105) |
| Sulfur, wppm | ~5-40 | (~20) |
| Kinetic viscosity at 50° C., cSt | ~1-10 | (~4) |

TABLE 3

Typical (exemplary) second diesel additive feed

| | | |
|---|---|---|
| Density at 15° C., kg/$m^3$ | ~800-900 | (~830) |
| Cloud point, ° C. | ~−25-0 | (~−21.0) |
| T50 Boiling Point, ° C. | ~200-290 | (~264.1) |
| Flash point, ° C. | ~50-70 | (~60) |
| Sulfur, wppm | ~2.3-13 | (~7.3) |
| Kinetic viscosity at 50° C., cSt | ~1-10 | (~5) |

TABLE 4

Uncracked, hydrotreated vacuum resid product

| | |
|---|---|
| Sulfur, wppm | ~1280 |
| Kinematic Viscosity @50° C., cSt | ~442 |
| Pour Point, ° C. | ~24 |
| Density @15° C., kg/$m^3$ | ~945 |
| Water content, vol % | <0.5 |
| Ash content @550° C., wt % | <0.010 |
| Microcarbon residue, wt % | ~4.99 |
| Total sediment, wt % | <0.1 |
| Flash point, ° C. | >180 |
| CCAI | ~808 |
| Acid number, mg KOH/g | <2.5 |
| Al + Si content, mg/kg | ~8 |
| Ca content, mg/kg | ~3 |
| Na content, mg/kg | ~2 |
| Ni content, mg/kg | ~2000 |
| V content, mg/kg | ~4 |

Example 2 Bunker Fuel Composition

The process described in Example 1 results in a bunker fuel composition. In four illustrative, non-limiting examples, the vacuum resid can be combined with the first and second hydrotreated diesel additives in a vol %:vol %:vol % ratio of (e.g.) ~63:~27:~10 ("base blend"); ~50:~40:~10 ("low blend"); ~60:~40:~0 ("medium blend"); and ~70:~20:~10 ("high blend"). The individual characteristics of the resulting marine bunker fuel compositions are shown below in Table 5.

TABLE 5

| Properties | Base | Low | Med. | High |
|---|---|---|---|---|
| Density at 15° C. (kg/$m^3$) | 926.5 | 911.8 | 926.1 | 935.9 |
| CCAI | 807 | 805 | 806 | 809 |
| Sulfur (wppm) | 958 | 781 | 915 | 1080 |
| Kinetic Viscosity @50° C. (cSt) | 78.03 | 33.5 | 77.14 | 133.3 |
| Flash point (° C.) | 97 | 95 | 91 | 100 |
| Acid number (mg KOH/g) | <0.01 | <0.01 | <0.01 | <0.01 |
| Total sediment accelerated | 0.01 | 0.02 | 0.01 | 0.03 |
| Carbon residue (wt %) | 5.9 | 4.5 | 5.3 | 6.4 |
| Pour point (° C.) | −3 | −15 | 0 | 0 |
| Water (vol %) | 0.10 | 0.05 | 0.10 | 0.05 |
| Ash (wt %) | 0.008 | 0.004 | 0.020 | <0.001 |
| V, Na, Al, Si, Ca, Zn, P, (mg/kg) | ≤4 | ≤3 | ≤6 | ≤5 |

Example 3 Vacuum Resid Distillation Characteristics

Two vacuum resids were hydrotreated as described herein. The IP507 distillation profiles for each resid batch are shown in Table 6.

TABLE 6

| T % | Resid #1 temp. (° C.) | Resid #2 temp. (° C.) |
|---|---|---|
| IBP | 305 | 276 |
| T1 | 317.6 | 306.8 |
| T2 | 335 | 340 |
| T3 | 347.6 | 359.2 |
| T4 | 356.8 | 370.2 |
| T5 | 364.8 | 378 |
| T6 | 371 | 383 |
| T7 | 376.6 | 387.4 |
| T8 | 381.2 | 391.2 |
| T9 | 385.6 | 394.4 |
| T10 | 389.6 | 397.4 |
| T11 | 392.8 | 400.4 |
| T12 | 396.2 | 402.8 |
| T13 | 399.2 | 405.2 |
| T14 | 402.2 | 407.8 |
| T15 | 404.6 | 410.2 |
| T16 | 407.2 | 412.6 |
| T17 | 409.8 | 414.4 |
| T18 | 412.4 | 416.8 |
| T19 | 414.4 | 418.8 |
| T20 | 416.8 | 421 |
| T21 | 419 | 423 |
| T22 | 421.2 | 424.8 |
| T23 | 423.2 | 426.8 |
| T24 | 425.4 | 429 |
| T25 | 427.4 | 431 |
| T26 | 429.8 | 432.8 |
| T27 | 431.8 | 434.8 |
| T28 | 433.6 | 436.6 |
| T29 | 435.8 | 438.6 |
| T30 | 437.8 | 440.8 |
| T31 | 440.2 | 442.4 |
| T32 | 442 | 444.6 |
| T33 | 444 | 446.8 |
| T34 | 446.4 | 449.2 |
| T35 | 449 | 451.4 |
| T36 | 451.4 | 454 |
| T37 | 454 | 456.8 |
| T38 | 457 | 459.6 |
| T39 | 459.4 | 462.6 |
| T40 | 462.4 | 466 |
| T41 | 465.6 | 469.2 |
| T42 | 468.6 | 472.8 |
| T43 | 472 | 476.4 |
| T44 | 475 | 480.4 |
| T45 | 478.4 | 484 |
| T46 | 481.8 | 488 |
| T47 | 485.2 | 492 |
| T48 | 488.8 | 496.2 |
| T49 | 492.2 | 500.2 |
| T50 | 496 | 504.2 |
| T51 | 499.6 | 508.8 |
| T52 | 503.2 | 513 |
| T53 | 507 | 517.6 |
| T54 | 511 | 522.4 |
| T55 | 515.2 | 526.8 |
| T56 | 519.2 | 531.4 |
| T57 | | 536 |
| T58 | | 540.6 |
| T86 | | 686.6 |
| T87 | | 694.2 |
| T88 | | 701.6 |
| T89 | 716.8 | 709.2 |
| T90 | 726.4 | 717.4 |
| T91 | 736.4 | 725.2 |
| T92 | 750 | 733.2 |
| T93 | | 741.6 |

Example 4 Hydrotreatment to Reduce Nitrogen Content

On four separate days, four batches of vacuum resid were hydrotreated. The nitrogen content of these four batches was measured before and after hydrotreatment. Relevant data are shown in Table 7 below.

TABLE 7

| | Untreated feed stream | Hydrotreated vacuum resid |
|---|---|---|
| Batch 1 | 3000 | 1600 |
| Batch 2 | 3700 | 2100 |
| Batch 3 | 3100 | |
| Batch 4 | 3700 | 2300 |
| Min. | 3000 | 1600 |
| Max. | 3700 | 2300 |
| Mean | 3375 | 2000 |
| Std. Dev. | 377.49172 | 360.55513 |

The above examples are strictly exemplary, and should not be construed to limit the scope or understanding of the present invention. It should be understood by those skilled in the art that various changes may be made and equivalents may be substituted without departing from the true spirit and scope of the Invention. In addition, many modifications may be made to adapt a particular situation, material, composition of matter, process, process step or steps, to the objective, spirit and scope of the described invention. All such modifications are intended to be within the scope of the claims appended hereto. It must also be noted that as used herein and in the appended claims, the singular forms "a," "an," and "the" include plural referents unless the context clearly dictates otherwise. Each technical and scientific term used herein has the same meaning each time it is used. The use of "or" in a listing of two or more items indicates that any combination of the items is contemplated, for example, "A or B" indicates that A alone, B alone, or both A and B are intended. The publications discussed herein are provided solely for their disclosure prior to the filing date of the present application. Nothing herein is to be construed as an admission that the described invention is not entitled to antedate such publication by virtue of prior invention. Further, the dates of publication provided may be different from the actual publication dates which may need to be confirm ed independently.

What is claimed is:

1. A method for producing a low-sulfur bunker fuel composition, the method comprising:

hydrotreating a vacuum resid feed stream with hydrogen in the presence of a hydrotreating catalyst to reduce sulfur to no more than about 1500 parts per million (wppm) without substantially cracking the vacuum resid; and blending the hydrotreated vacuum resid with no more than about 10 vol % of a first diesel boiling range hydrocarbon stream and no more than about 40 vol % of a second diesel boiling range hydrocarbon stream to form the low-sulfur bunker fuel composition, wherein the hydrotreated vacuum resid makes up at least 60 vol % of the low-sulfur bunker fuel composition, wherein the vacuum resid feed stream has about 1000 to about 10000 wppm sulfur, the first diesel boiling range hydrocarbon stream has no more than about 20 wppm sulfur, and the second diesel boiling range hydrocarbon stream has no more than about 10 wppm sulfur.

2. The method of claim 1, wherein the vacuum resid feed stream has about 6000 to about 10000 wppm sulfur.

3. The method of claim 2, wherein the vacuum resid feed stream has about 6000 to about 8000 wppm sulfur.

4. The method of claim 1, wherein the sulfur of the hydrotreated vacuum resid is reduced to no more than about 1400 wppm.

5. The method of claim 4, wherein the sulfur of the hydrotreated vacuum resid is reduced to no more than about 1300 wppm.

6. The method of claim 5, wherein the sulfur of the hydrotreated vacuum resid is reduced to no more than about 1200 wppm.

7. The method of claim 6, wherein the sulfur of the hydrotreated vacuum resid is reduced to no more than about 1000 wppm.

8. The method of claim 1, wherein the hydrotreated vacuum resid is blended with no more than about 25 vol % of the second diesel boiling range hydrocarbon stream.

9. The method of claim 8, wherein the hydrotreated vacuum resid is blended with no more than about 20 vol % of the second diesel boiling range hydrocarbon stream.

10. The method of claim 9, wherein the hydrotreated vacuum resid is blended with no more than about 15 vol % of the second diesel boiling range hydrocarbon stream.

11. The method of claim 1, wherein the hydrotreated vacuum resid is blended with no more than about 7.5 vol % of the first diesel boiling range hydrocarbon stream.

12. The method of claim 11, wherein the hydrotreated vacuum resid is blended with no more than about 5 vol % of the first diesel boiling range hydrocarbon stream.

13. The method of claim 1, wherein the vacuum resid feed stream is hydrotreated under at least 130 bar of pressure.

* * * * *